US009126818B2

(12) United States Patent
Chase et al.

(10) Patent No.: US 9,126,818 B2
(45) **Date of Patent: *Sep. 8, 2015**

(54) HANDS FREE, CONTROLLED AUTOFILL FOR A DISPENSER

(71) Applicant: Whirlpool Corporation, Benton Harbor, MI (US)

(72) Inventors: Kevin M. Chase, St. Joseph, MI (US); Brian P. Janke, St. Joseph, MI (US); Farhad Ashrafzadeh, Bowling Green, KY (US); Shreecharan Kanchanavally, Naperville, IL (US); James Kerner, Indianapolis, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/331,500

(22) Filed: Jul. 15, 2014

(65) Prior Publication Data

US 2014/0319168 A1 Oct. 30, 2014

Related U.S. Application Data

(63) Continuation of application No. 13/371,688, filed on Feb. 13, 2012, now Pat. No. 8,813,794, which is a continuation-in-part of application No. 12/550,831, filed on Aug. 31, 2009, now Pat. No. 8,327,889, which (Continued)

(51) Int. Cl.
*B65B 1/30* (2006.01)
*B67D 1/08* (2006.01)

(Continued)

(52) U.S. Cl.
CPC ..... *B67D 1/0878* (2013.01); *B67D 1/0858* (2013.01); *B67D 1/0888* (2013.01);
(Continued)

(58) Field of Classification Search
CPC .. B67D 1/0878; B67D 1/0888; B67D 1/1236; F25D 23/126; F25D 2700/00
USPC ..... 141/83, 94–96, 192, 198, 351, 360, 1; 73/290 R; 62/389; 250/221, 222.1; 222/23, 52
See application file for complete search history.

(56) References Cited

U.S. PATENT DOCUMENTS 3,823,846 A 7/1974 Probst
4,099,167 A 7/1978 Pomerantz et al.

(Continued)

FOREIGN PATENT DOCUMENTS

EP 0644386 A1 3/1995
EP 1521066 A1 4/2005

(Continued)

OTHER PUBLICATIONS

RE33435, Reissued Nov. 13, 1990, Application No. 17487 filed Feb. 24, 1987, Koblasz et al "Ultrasound Level Detector", Reissue of Patent No. 4559979, issued Dec. 24, 1985, Appl No. 559288 filed Dec. 8, 1983.

*Primary Examiner* — Jason K Niesz

(57) ABSTRACT

A dispensing system includes one or more digital image capture devices for capturing images in a dispenser well and a digital image analyzer operatively coupled to the digital image capture device(s) for analyzing the images for use in regulating a dispensing operation. The digital image analyzer evaluates digital images captured by the digital image capture device(s) to determine various characteristics of a container, such as the height and position of the container.

22 Claims, 4 Drawing Sheets

Related U.S. Application Data is a continuation-in-part of application No. 12/103,170, filed on Apr. 15, 2008, now Pat. No. 7,673,661.

(60) Provisional application No. 60/914,462, filed on Apr. 27, 2007.

(51) Int. Cl.

| | |
|---|---|
| ***B67D 1/12*** | (2006.01) |
| ***G07F 13/06*** | (2006.01) |
| *F25D 23/12* | (2006.01) |

(52) U.S. Cl.

CPC ..... *B67D 1/124* (2013.01); *B67D 1/1236* (2013.01); *G07F 13/06* (2013.01); *F25D 23/126* (2013.01); *F25D 2700/06* (2013.01)

(56) References Cited

U.S. PATENT DOCUMENTS

| | | | | |
|---|---|---|---|---|
| 4,121,433 | A | | 10/1978 | Pomerantz |
| 4,202,387 | A | | 5/1980 | Upton |
| 4,254,896 | A | | 3/1981 | Stanford et al. |
| 4,257,237 | A | | 3/1981 | Hoenisch |
| 4,266,144 | A | | 5/1981 | Bristol |
| 4,282,430 | A | | 8/1981 | Hatten et al. |
| 4,295,370 | A | | 10/1981 | Bristol |
| 4,437,497 | A | | 3/1984 | Enander |
| 4,437,499 | A | | 3/1984 | Devale |
| 4,440,200 | A | | 4/1984 | DeVale et al. |
| 4,446,896 | A | | 5/1984 | Campagna |
| 4,458,735 | A | | 7/1984 | Houman |
| 4,559,979 | A | | 12/1985 | Koblasz et al. |
| 4,564,882 | A | | 1/1986 | Baxter et al. |
| 4,572,253 | A | | 2/1986 | Farmer et al. |
| 4,733,381 | A | | 3/1988 | Farmer et al. |
| 4,780,861 | A | | 10/1988 | Stembridge et al. |
| 4,798,232 | A | | 1/1989 | Stembridge et al. |
| 4,817,689 | A | | 4/1989 | Stembridge et al. |
| 4,883,100 | A | | 11/1989 | Stembridge et al. |
| 4,890,651 | A | | 1/1990 | Stembridge et al. |
| 4,917,155 | A | | 4/1990 | Koblasz et al. |
| 4,929,843 | A | * | 5/1990 | Chmielewski et al. .. 250/559.05 |
| 4,944,335 | A | | 7/1990 | Stembridge et al. |
| 4,961,456 | A | | 10/1990 | Stembridge et al. |
| 4,994,336 | A | | 2/1991 | Benecke et al. |
| 5,017,909 | A | | 5/1991 | Goekler |
| 5,036,892 | A | | 8/1991 | Stembridge et al. |
| 5,165,255 | A | | 11/1992 | Alvarez et al. |
| 5,406,843 | A | | 4/1995 | Hannan et al. |
| 5,414,603 | A | | 5/1995 | Conway |
| 5,460,007 | A | | 10/1995 | Reed et al. |
| 5,491,333 | A | | 2/1996 | Skell et al. |
| 5,491,423 | A | | 2/1996 | Turetta |
| 5,534,690 | A | * | 7/1996 | Goldenberg et al. ..... 250/222.1 |
| 5,551,598 | A | | 9/1996 | Cutsinger |
| 5,573,041 | A | | 11/1996 | Skell et al. |
| 5,640,468 | A | * | 6/1997 | Hsu ..... 382/190 |
| 5,744,793 | A | | 4/1998 | Skell et al. |
| 5,819,547 | A | | 10/1998 | Oh |
| 5,823,730 | A | | 10/1998 | LaRovere et al. |
| 5,862,844 | A | | 1/1999 | Perrin |
| 5,895,910 | A | | 4/1999 | Christian |
| 5,902,998 | A | | 5/1999 | Olson et al. |
| 5,912,870 | A | | 6/1999 | Kanno et al. |
| 6,046,447 | A | | 4/2000 | Skell et al. |
| 6,082,419 | A | | 7/2000 | Skell et al. |
| 6,100,518 | A | * | 8/2000 | Miller ..... 250/222.1 |
| 6,227,265 | B1 | | 5/2001 | Skell et al. |
| 6,265,709 | B1 | | 7/2001 | Olson et al. |
| 6,337,959 | B1 | | 1/2002 | Kwak et al. |
| 6,394,153 | B2 | | 5/2002 | Skell et al. |
| 6,400,518 | B1 | | 6/2002 | Bhaumik et al. |
| 6,406,227 | B1 | * | 6/2002 | Titus et al. ..... 409/81 |
| 6,473,190 | B1 | | 10/2002 | Dosmann |
| 6,528,781 | B1 | | 3/2003 | Olson et al. |
| 6,539,797 | B2 | | 4/2003 | Livingston et al. |
| 6,546,741 | B2 | | 4/2003 | Yun et al. |
| 6,681,585 | B1 | | 1/2004 | Stagg et al. |
| 6,688,134 | B2 | | 2/2004 | Barton et al. |
| 6,705,356 | B2 | | 3/2004 | Barton et al. |
| 6,742,387 | B2 | | 6/2004 | Hamamoto et al. |
| 6,761,284 | B2 | | 7/2004 | Knepler |
| 6,766,687 | B2 | | 7/2004 | Florenz et al. |
| 6,789,585 | B1 | | 9/2004 | Janke |
| 6,840,100 | B1 | | 1/2005 | Wotiz |
| 6,988,405 | B2 | | 1/2006 | Jakoby et al. |
| 7,028,725 | B2 | * | 4/2006 | Hooker ..... 141/141 |
| 7,034,272 | B1 | * | 4/2006 | Leonard et al. ..... 250/208.1 |
| 7,109,512 | B2 | | 9/2006 | Wirthlin |
| 7,201,005 | B2 | | 4/2007 | Voglewede et al. |
| 7,210,601 | B2 | | 5/2007 | Hortin et al. |
| 7,353,850 | B2 | | 4/2008 | Greiwe et al. |
| 7,447,558 | B2 | * | 11/2008 | Pratt ..... 700/118 |
| 8,028,728 | B2 | * | 10/2011 | Cooper ..... 141/351 |
| 8,813,794 | B2 | * | 8/2014 | Ashrafzadeh et al. ..... 141/94 |
| 2004/0226962 | A1 | | 11/2004 | Mazursky et al. |
| 2005/0103799 | A1 | | 5/2005 | Litterst et al. |
| 2005/0138951 | A1 | | 6/2005 | Hooker |
| 2005/0178279 | A1 | | 8/2005 | Valls |
| 2005/0268624 | A1 | | 12/2005 | Voglewede et al. |
| 2006/0096303 | A1 | | 5/2006 | Kavounas |
| 2006/0196212 | A1 | | 9/2006 | Jenkins, Jr. et al. |
| 2006/0268639 | A1 | | 11/2006 | Yoon et al. |
| 2007/0009365 | A1 | | 1/2007 | Litterst et al. |
| 2008/0023659 | A1 | | 1/2008 | Dietz et al. |
| 2008/0083475 | A1 | | 4/2008 | Lamb |
| 2011/0214441 | A1 | * | 9/2011 | Ashrafzadeh et al. ..... 62/129 |
| 2013/0228250 | A1 | * | 9/2013 | Agam et al. ..... 141/83 |

FOREIGN PATENT DOCUMENTS

| | | | |
|---|---|---|---|
| JP | 767892 | A | 3/1995 |
| JP | 2002100976 | A | 4/2002 |
| JP | 2005263278 | A | 9/2005 |

* cited by examiner

HANDS FREE, CONTROLLED AUTOFILL FOR A DISPENSER

CROSS-REFERENCE TO RELATED APPLICATIONS

The present invention represents a continuation of U.S. patent application Ser. No. 13/371,688, filed Feb. 13, 2012, which is a continuation-in-part of U.S. patent application Ser. No. 12/550,831, filed Aug. 31, 2009, now U.S. Pat. No. 8,327, 889, which constitutes a continuation-in-part of U.S. patent application Ser. No. 12/103,170, filed Apr. 15, 2008, now U.S. Pat. No. 7,673,661, which claims priority to U.S. Provisional Patent Application 60/914,462, filed Apr. 27, 2007.

BACKGROUND OF THE INVENTION

1. Field of the Invention

The present invention pertains to the art of dispensing and, more particularly, to a sensor system that employs digital imaging technology to determine, among other things, the dimensions, volume and positioning of a container in a dispensing well.

2. Description of the Related Art

Refrigerators having built-in ice/water dispensers are well known in the art. In general, the dispensers are mounted to a door of the refrigerator for the purpose of dispensing ice and/or water without requiring a user to access a refrigerator compartment. A typical dispenser includes a dispenser well into which a container is placed. Once the container is in position, an actuator is operated to release the ice and/or water into the container.

In many cases, the actuator is a pressure sensitive mechanical switch. Typically, the switch is operated by pushing the container against, for example, a lever. The lever, in turn, operates the switch that causes the ice and/or water to be dispensed. A number of dispensers employ multiple actuators, one for ice and another for water, while other dispensers employ a single actuator. Dispensers which employ a single actuator typically require additional control elements that enable a user to select between ice and water dispensing operations. Several manufacturers have converted from mechanical switches to electrical or membrane switches. Functioning in a similar manner, a container is pushed against the membrane switch to initiate the dispensing operation. Still other arrangements employ actuator buttons provided on a control panel of the dispenser. With this type of arrangement, the user continuously depresses a button to release ice and/or water into the container.

Over time, mechanical and membrane switches can wear out. Physical interaction with the switches results in wear and tear on contact points, springs, levers and the like which eventually require replacement. In addition, most existing systems lack an automatic cut-off feature. More specifically, once activated, the dispenser will discharge water or ice until the pressure is removed from the actuator. If the user is momentarily distracted, or if the dispenser is operated by an inexperienced individual such as a child, ice and/or water can overflow the container. In order to address this concern, manufacturers have developed automatic cut-off features for dispensers. However, existing automatic cut-off controls, many of which are based solely on container height, are not overly effective. If a container is not properly located within the dispenser well, either too little or too much water/ice will be dispensed. In addition, existing systems are not able to account for various container shapes, such as water bottles, coffee pots and the like. Differences in container shape affect how much liquid should be dispensed into the container. Furthermore, existing systems often employ sensors or displays mounted on a bezel which prevents the bezel from being changed without significant modification.

Therefore, despite the existence of refrigerator dispensers in the prior art, there exists a need for an enhanced dispensing system, whether limited to refrigerators or other dispensing arrangements such as countertop dispensers. More specifically, there exists a need for a dispensing system that employs a sensor system that can detect the dimensions, volume and positioning of a container and initiates a dispensing operation based on the particular, properly positioned container. In addition, there exists a need for a sensor system that does not interfere with the changeability of a bezel module associated with a display/control of the dispenser.

SUMMARY OF THE INVENTION

The present invention is directed to a sensing system for a dispenser, such as a refrigerator dispenser or countertop dispenser. The sensing system is arranged in the dispenser area and configured to detect a container positioned to receive ice and/or water. In accordance with the invention, the sensing system employs at least one digital image capture device focused upon the dispensing area. The digital image capture device(s) is coupled to a digital image analyzing system that processes images of the dispensing area to determine the presence of a container within the dispensing area. Additionally, digital images of a container within the dispensing area are processed to determine dimensional, e.g., height, volume and the like characteristics, and positional aspects of the container of the container. With this information, the container can be automatically filled to a pre-specified level or volume. Furthermore, the digital image capture device is mounted so as to not interfere with the changing of a bezel associated with the dispenser.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
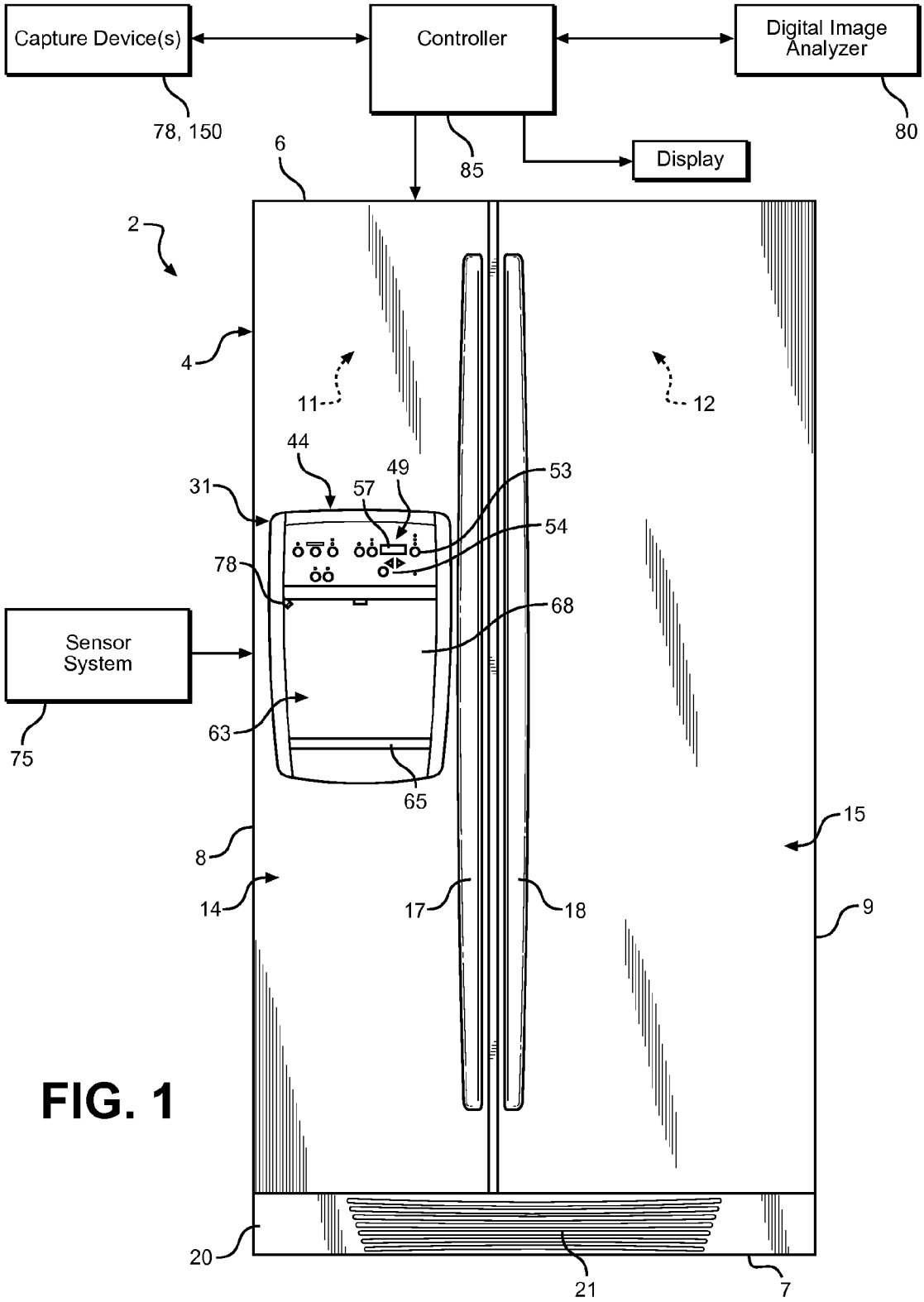
FIG. 1 is a front elevational view of a refrigerator incorporating a dispenser having a sensor system constructed in accordance with the present invention.

With initial reference to FIG. 1, a refrigerator constructed in accordance with the present invention is generally indicated at 2. Refrigerator 2 includes a cabinet 4 having a top wall 6, a bottom wall 7 and opposing side walls 8 and 9. In a manner known in the art, refrigerator 2 includes a freezer compartment 11 arranged along side a fresh food compartment 12. Freezer compartment 11 includes a corresponding freezer compartment door 14 and fresh food compartment 12 includes a corresponding fresh food compartment door 15. In a manner also known in the art, each door 14, 15 includes an associated handle 17, 18. Refrigerator 2 is also shown to include a kick plate 20 arranged at a bottom portion thereof having a vent 21 that permits air to flow into refrigeration components (not shown) that establish and maintain desired temperatures in freezer compartment 11 and fresh food compartment 12. In the embodiment shown, refrigerator 2 constitutes a side-by-side model. However, it should be understood that the present invention could also be employed in connection with a wide variety of refrigerators, including top mount, bottom mount, and French-style refrigerator models.

In accordance with the invention, refrigerator 2 includes an icemaker 22, a dispenser assembly 31 having a main housing 44 and a control panel 49 defining a bezel (not separately labeled). Control panel 49 includes first and second rows of control buttons 53 and 54 which enable a user to select a preferred dispensing operation. Control panel 49 further includes a display 57 which, in addition to functioning in cooperation with dispenser assembly 40, enables the user to select particular operational parameters for refrigerator 2 such as, desired temperatures for freezer compartment 11 and fresh food compartment 12.

Dispenser assembly 31 includes a dispenser well 63 establishing a dispensing zone defined by a base or container support portion 65 and a recessed, upstanding wall section 68. A nozzle or spigot (not separately labeled) is arranged in an upper portion of dispenser well 63 and aimed to deliver a flow of water or other liquid downward into a container (shown at 91 in FIG. 2) placed in dispenser well 63. An ice outlet (not shown) is provided in an upper portion of dispenser well 63 for dispensing ice. In accordance with an aspect of the invention, dispenser assembly 31 includes a sensor system 75 that detects both the size and shape of a container placed within dispenser well 63. As will be detailed more fully below, sensor system 75 employs at least one digital image capture device 78 positioned in dispenser well 63.

Figure 2:
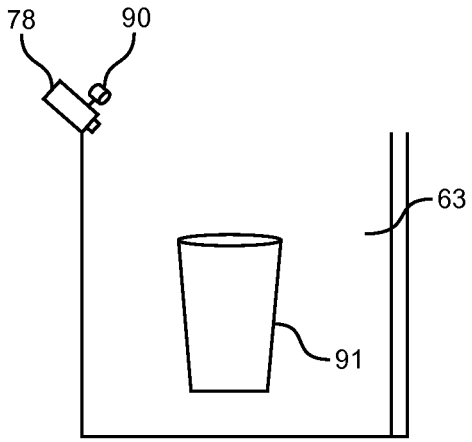
FIG. 2 is a schematic representation of a sensor system employing digital imaging to determine container height and shape.

Digital image capture device 78 can take on a variety of forms, such as a charged/coupled device (CCD) camera or complimentary metal oxide semiconductor (CMOS) camera. As shown in FIG. 2, digital image capture device 78 is preferably operatively connected to a light source 90 which produces light of one or more wavelengths. That is, light source 90 can bathe dispenser well 63 in white light, colored light or non-visible light depending upon a particular parameter of interest. Digital image capture device 78 is linked to a controller 85 of sensor system 75 which performs algorithmic processing of the data. Light source 90 (either IR or visible) is utilized to illuminate a container 91, allowing capture device 78 to accurately detect a rim, while enabling the diameter, height and other physical parameters of container 91 to be determined, from which an estimated volume can be computed.

Capture device 78 is preferably mounted in an uppermost portion of dispenser well 63 so as to not interfere with the changeability of a bezel for dispenser well 63. In addition, capture device 78 is preferably focused downward at both ice and water dispensing areas to capture digital images of objects that enter dispenser well 63. Objects in dispenser well 63 are contrasted against a reference image, i.e., the background of dispenser well 63, for clarity. In the depicted embodiment, digital image capture device 78 takes the form of a camera that is positioned in dispenser well 63 to capture a side view of container 91. As will be discussed more fully below, the image is passed to digital image analyzing system 80. In accordance with certain embodiments of the invention, analyzing system 80 corrects the image and performs edge based image segmentation of the image in order to detect the top and bottom points of container 91, along with the opening of the container 91, thereby verifying the presence of container 91, movement of container 91 in dispenser well 63 and the requisite physical parameters. With this information, controller 85 can effectively regulate operation of dispensing assembly 31, including display 57 and the liquid/ice dispensing operations.

Figure 3:
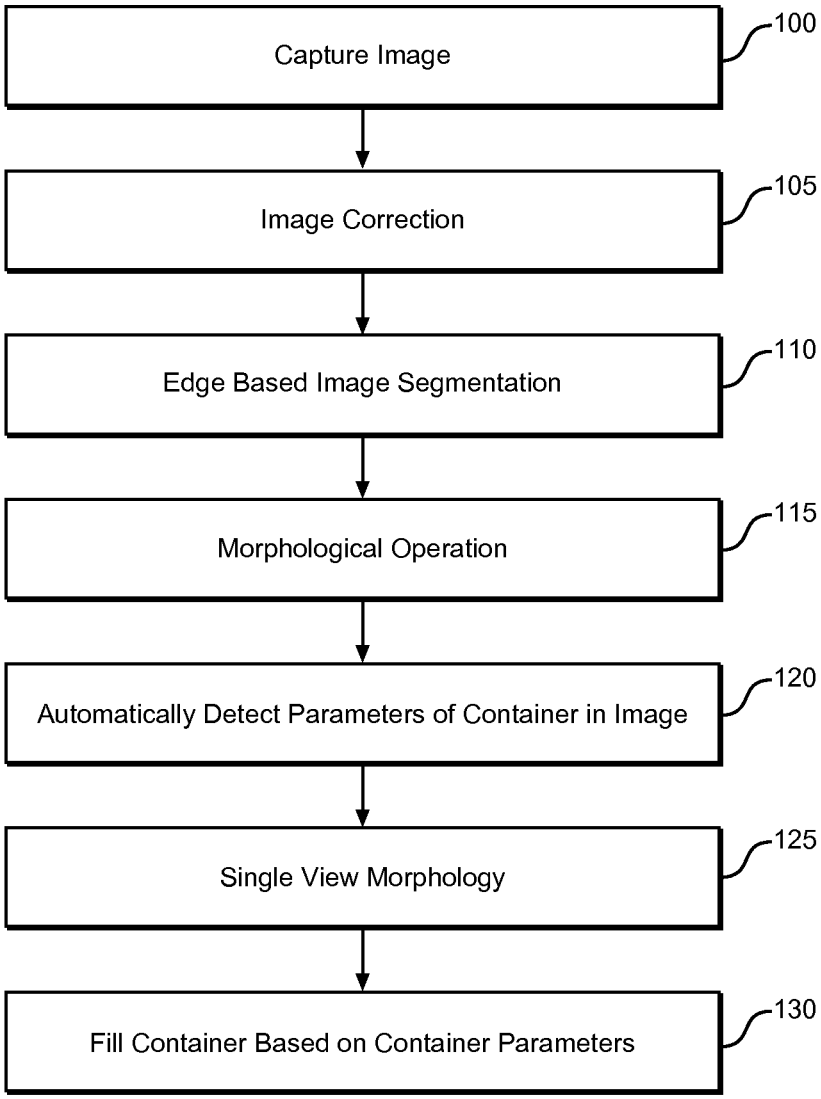
FIG. 3 is a flow chart illustrating the dispensing method in accordance with the present invention.

The operation of sensor system 75 according to a preferred embodiment of the present invention will now be described with reference to FIG. 3. As shown in block 100, sensor system 75 includes digital image capture device 78 which captures one or more digital images and sends the digital image(s) to controller 85 as such objects enter dispenser well 63. Controller 85 passes the digital images to digital image analyzer 80 which analyzes the images to first determine that container 91 is present through image comparisons, then determines the shape and volume of a container 91 in dispenser well 63, as well as any container movement. More particularly, an image processing algorithm is carried out to determine the shape and size of container 91. That is, each image is first subjected to an image correction step in block 105 to correct distortions in the image that result from the use of a fish eye lens or the like in image capture device 78. The corrected image then undergoes edge based image segmentation to distinguish objects from the background in block 110. The background color is filtered out of the image, thus filtering out the background from the image. Following segmentation, the image is subjected to a morphological operation in block 115 to remove additional noise so the edges of the container appear clearer. This is accomplished by blowing up the image so the edges of the container appear thicker and unwanted background noise can be removed. The container is now fully detected and separated from the background. Thus, the top, bottom, and opening points of the container are automatically detected in block 120. The image then undergoes single view morphology in block 125, a process by which the actual dimensions of the container are determined from the measurements of the image of the container. In particular, the pixel points of the image are determined and a projection algorithm is used to determine the actual height and diameter of the container. Liquid or ice is then be automatically dispensed to fill the container in block 130 based on the particular container parameters. If container 91 is moved relative to dispenser well 63 such that container 91 becomes mis-aligned prior to completion of the dispensing operation, the dispensing operation can be cut off to prevent spillage.

Figure 4:
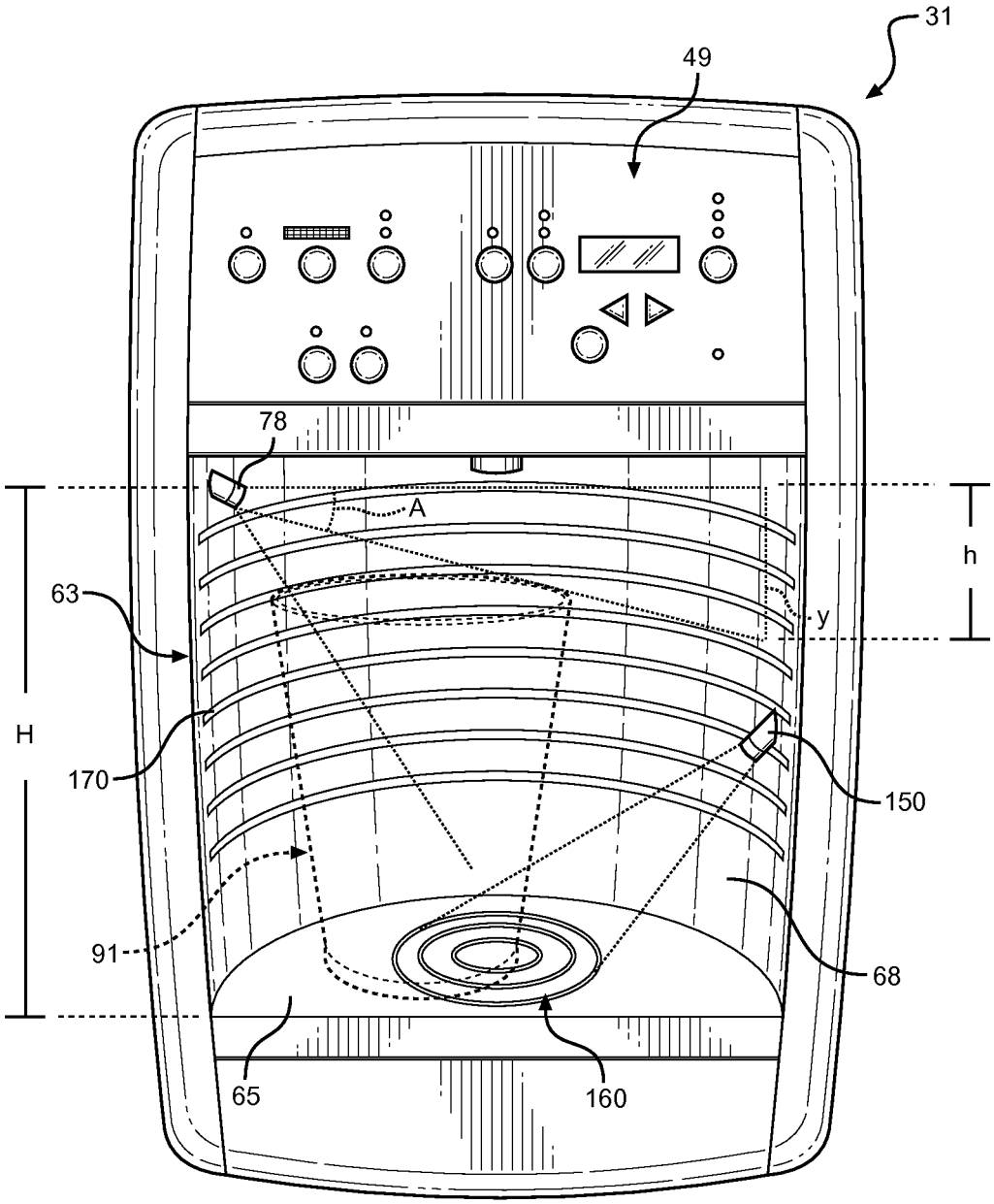
FIG. 4 is a perspective view illustrating another embodiment wherein multiple digital image capture devices of the sensor system are employed in determining container height and positioning within a dispensing zone.

As indicated above, sensor system 75 can be employed to determine a height of container 91. In accordance with the overall invention, this desired function can be carried out in various ways. FIG. 4 illustrates another arrangement wherein digital image capture device 78, which is again preferably located in an upper position within dispenser well or dispensing zone 63, has a certain overall field of vision which extends both above and below a potential height of container 91. More specifically, as depicted, this field of vision has an upper limit located at a maximum height H associated with the dispensing zone 63 and a lower limit preferably capturing a remote portion of base 65. When container 91 is placed within dispensing zone 63, capture device 78 still has the upper limit vision, but container 91 blocks or distorts at least part of the remaining field of vision. As shown here by way of example, the upper rim (not separately labeled) of container 91 limits an unobstructed field of vision from a predetermined known angle to a smaller angle A having an associated vertical distance y. This angle and distance information can be readily processed by digital image analyzer 80 to establish a nominal height for container 91. That is, the geometric positioning between capture device 78 and container 91 and a triangulation technique enable this height parameter to be readily determined for filling purposes. Basically, a nominal container height for auto-fill purposes can be readily established by subtracting distance y from height H.

Certainly, the positioning of container 91 within dispensing zone 63 will have an effect on the determined height value. In addition, as indicated above, an aspect of the invention includes utilizing sensor system 75 to assure that container 91 is properly positioned in dispensing zone 63 so as to at least be aligned with the dispensing nozzle or spigot in order to permit an autofill operation. In furtherance of this aspect of the invention, FIG. 4 also illustrates an embodiment wherein a second digital image capture device 150 is located in a lower section of dispensing zone 63 and directed onto a central region of base 65. More specifically, base 65 is provided with a target 160, for example a bull's-eye containing multiple concentric circles, directly below the nozzle. When container 91 is placed centrally in dispensing zone 63, container 91 should cover or obscure at least the innermost portions of target 160 which can be readily detected by capture device 150. This target information can also be used to determine if container 91 is being manually held above base 65. By the same analysis, data from capture device 150 can be used to readily determine if container 91 is positioned offset from such a central position. If fact, based on the amount of exposure of target 160, the presence and positioning of container 91 in dispensing zone 63 can be ascertained such that the auto-dispensing operation will only be initiated through controller 85 if container 91 is appropriately positioned to directly receive the liquid and/or ice being dispensed. That is, the dispensing operation is prevented if target 160, or at least a predetermined portion thereof, is in the field of vision of capture device 150, thereby indicating that container 91 is either not present or improperly positioned. As also discussed above with respect to an earlier described embodiment, if container 91 is moved relative to dispensing zone 63 such that container 91 becomes mis-aligned prior to completion of the dispensing operation, the dispensing operation can be cut-off to prevent spillage.

It is also contemplated to utilize capture device 78 in determining a nominal height of container 91 utilizing a similar target-based arrangement. In accordance with this aspect of the invention, at least a portion of upstanding wall section 68, opposite capture device 78, is provided with a target shown in the form of a series of horizontally extending and vertically spaced indicators 170. At this point, it should be understood that indicators 170 can take various forms in accordance with the invention, including spaced lines, ridges, indentations or the like, which preferably just blend into the overall aesthetics of dispenser assembly 31. In any case, in a manner similar to that described above, only certain portions of the vertically spaced indicators 170 of this second target will be in the field of vision of capture device 78 when container 91 is in dispensing zone 63. With the information, a distance h for container 91 can be ascertained which, in a manner similar to the determined distance y discussed above, can be subtracted from the overall height value H to establish a nominal container height for filling purposes.

Certainly, capture devices 78 and 150, as well as other such devices, can be advantageously utilized together in an overall hands free, controlled autofill dispensing system. With this in mind, it must be recognized that the information obtained by the multiple capture devices are interrelated and have an effect on each other. For example, an established nominal container height can be altered if the container is repositioned. To this end, the information from the multiple capture devices combine to have a synergistic effect on the overall accuracy of the system. For at least this reason, when multiple capture devices are employed, it is preferable to either enable simultaneous imaging and analysis, or specifically provide for switching between the first and second images for analysis throughout the dispensing operation. The image updates are frequently performed throughout the entire dispensing operation to assure, at the very least, that proper container positioning is maintained and the proper fill height is established.

Although described with reference to preferred embodiments of the invention, it should be readily understood that various changes and/or modifications can be made to the invention without departing from the spirit thereof. In general, it should be readily apparent that the present invention employs a sensing system which can advantageous sense or determine the presence, positioning, height, shape and/or volume of a container placed in a dispensing well. Additionally, a fill level of the container and even the material of the container can actually be sensed. A dispensing operation can be automatically performed when the presence of the container is sensed in the dispensing well and the container is properly positioned and maintained relative to a dispensing nozzle of the well. In addition, the actual dispensing operation is controlled or regulated based on the height and volume of the container, as well as sensed movement of the container in the dispensing well. In this manner, dispensing operations can only be performed when a container is appropriately arranged in the dispensing well and the dispensing operation will be timely terminated based on the physical parameters of the particular container employed and/or any improper shifting of the container during the fill operation. Although described with reference to a refrigerator dispenser, the invention can also be employed with other types of liquid and/or ice, such as countertop dispensers for ice and/or various beverages including coffee, milk, soda, water and the like. Furthermore, it should be understood that various digital imaging devices could be employed, including both still picture and video camera imaging. Finally, it should be realized that the invention can use other sensing arrangements, such as known ultrasonic sensors, in combination with one or more digital imaging devices. In any case, the invention is only intended to be limited by the scope of the following claims.

What is claimed is:

1. A method of performing a dispensing operation from a dispenser assembly:

capturing a first image of a container with a first digital image capture device;

analyzing the first image; and regulating the dispensing operation based on the first image.

2. The method of claim 1, wherein the first image is analyzed in determining a height of the container.

3. The method of claim 2, further comprising: employing geometric positioning between the first digital image capture device and the container in analyzing the first image.

4. The method of claim 3, wherein analyzing the first image includes determining an angle from the first digital image capture device and an upper rim of the container.

5. The method of claim 4, wherein the height of the container is determined by subtracting a height value from a maximum container height.

6. The method of claim 3, further comprising: employing a triangulation technique in analyzing the first image.

7. The method of claim 1, further comprising: capturing a second image of the container with a second digital image capture device; and regulating the dispensing operation based on both the first and second images.

8. The method of claim 7, wherein the first image is analyzed in determining a height of the container.

9. The method of claim 8, wherein the second image is analyzed in determining a position of the container.

10. The method of claim 7, further comprising: capturing the first image from an upper location; and capturing the second image from a lower location.

11. The method of claim 7, wherein at least one of the first and second images is directed to at least one fixed target.

12. The method of claim 11, wherein the container blocks at least a portion of the at least one target.

13. The method of claim 12, wherein the first and second images are respectively directed to first and second targets.

14. The method of claim 12, further comprising: preventing the dispensing operation if the at least one target is in the at least one of the first and second images.

15. The method of claim 10, further comprising: wherein the first image is directed to a height of a container and the second image is directed to a position of the container.

16. The method of claim 7, further comprising: switching between the first and second images for analysis during the dispensing operation.

17. A dispenser assembly for selectively releasing at least one of liquid and ice to a consumer through a dispensing operation, said dispenser assembly comprising: a base section for supporting a container; a recessed upstanding wall section; opposing side wall sections; a dispensing outlet for delivering the at least one of liquid or ice; and a sensor system including a first digital image capture device for capturing a first image and a digital image analyzer operatively coupled to the first digital image capture device for evaluating the image to regulate the dispensing operation.

18. The dispenser assembly according to claim 17, further comprising: a second digital image capture device image for capturing a second image of the container, wherein the digital image analyzer evaluates both the first and second images in regulating the dispensing operation.

19. The dispenser assembly according to claim 18, wherein the first image capture device is located in the upper portion of the recessed upstanding wall section and the second image capture device is located in the lower portion of the recessed upstanding wall section.

20. The dispenser assembly according to claim 19, further comprising: first and second targets, wherein the first and second image capture devices are directed to take images of the first and second targets respectively.

21. The method of claim 1, wherein at least a portion of the dispensing assembly is located in a door of a refrigerator and the dispensing operation dispenses at least one of water and ice.

22. The dispenser assembly of claim 17, wherein the recessed upstanding wall section is formed in a door of a refrigerator.

* * * * *